US007922026B2

(12) United States Patent
Westphal

(10) Patent No.: US 7,922,026 B2
(45) Date of Patent: Apr. 12, 2011

(54) DEGASSING CONTAINER

(75) Inventor: Scott K. Westphal, New York, NY (US)

(73) Assignee: SKW Trust, Miami Beach, FL (US)

( * ) Notice: Subject to any disclaimer, the term of this patent is extended or adjusted under 35 U.S.C. 154(b) by 1069 days.

(21) Appl. No.: 11/683,837

(22) Filed: Mar. 8, 2007

(65) Prior Publication Data

US 2008/0217203 A1 Sep. 11, 2008

(51) Int. Cl.
*B65D 51/16* (2006.01)

(52) U.S. Cl. ..... 220/366.1

(58) Field of Classification Search ..... 220/366.1, 220/615, 619, 623
See application file for complete search history.

(56) References Cited

U.S. PATENT DOCUMENTS 1,766,173 A * 6/1930 Hills ..... 53/432
4,252,268 A * 2/1981 Haire ..... 229/120
4,376,506 A * 3/1983 Westphal ..... 229/5.6
4,508,569 A * 4/1985 Kumasaka et al. ..... 106/14.12
5,445,291 A * 8/1995 Daniel ..... 220/366.1
5,872,266 A 2/1999 Nitobe
5,893,461 A 4/1999 Walters
5,992,635 A 11/1999 Walters
6,056,439 A 5/2000 Graham
6,070,728 A 6/2000 Overby

* cited by examiner

*Primary Examiner* — Stephen Castellano

(74) *Attorney, Agent, or Firm* — Pillsbury Winthrop Shaw Pittman LLP

(57) ABSTRACT

The present invention discloses a container comprising a circular end wall, a peripheral body wall, and an annular rolled end seam. A channel is created in the rolled end seam and is in communication with the interior of the container. A one-way valve forms a seal between the rolled end seam and an outer surface of the body wall. The one-way valve allows gases from the interior of the container to escape from the container during packaging.

14 Claims, 4 Drawing Sheets

DEGASSING CONTAINER

BACKGROUND OF THE INVENTION

1. Field of Invention

The present invention is generally related to packaging containers, for holding materials or goods, and more particularly, to such containers having a degassing valve.

2. Background

As products are packaged and sealed, air may become entrapped inside the package or gases may be produced by the products. For example, many dry and frozen foods (e.g., coffee, tea, snacks, flour, sugar, pasta, pet food, etc.) are packaged while hot. The hot or warm contents or materials cause (while the contents cool) pressure to build in the interior of the packages. To prevent excessive pressure from building up, some packages are degassed through valves provided on the package. Generally, the use of degassing valves in the top or in the sidewall of a package or container for the release of entrapped air or gases is known in the art. One advantage of degassing is that it helps preserve the products within the package.

The prior art discloses several methods for degassing. The use of a pressure release valve covering a hole in the wall of a container is known in the art. Also known are hermetic packages having a valve mounted on a wall panel with filters for venting gases within. Degassing valves that include a manually moveable element for enabling the venting of gas from the interior are also known. Examples of various prior art containers of the types discussed above are shown in U.S. Pat. Nos. 5,782,266; 5,893,461; 5,992,635; 6,056,439; and 6,070,728.

Degassing valves are typically used on packages such as bags, gusseted packages, and rigid plastic and metal containers, such as cans. Degassing valves are often engineered to also restrict the entrance of outside air. Ambient atmosphere contains degrading oxygen and deleterious microbes that are preferably prevented from entering the package. Several methods have been developed for preventing contact of atmospheric air with the contents of a package or container. One known method of preventing outside air from entering a package is the use of a sealed, rolled end on containers such as cans. Typically, a container's top or bottom is rolled or curled with the body or sidewall. A current methodology includes the insertion of a sealant or lining compound contained within a rolled end seam. The sealant is rolled into the seam; specifically, as the can body wall and end wall are rolled together to form a double seam, the compound is disbursed circumferentially (i.e., curled) within the rolled end, thus forming a continuous gasket that prevents the entrance or escape of air into the interior of the container.

The solutions provided by the prior art for allowing gases to escape from the package interior (and preventing the ingress of air) are expensive to fabricate and difficult to insert into the packaging. The present invention overcomes these issues.

SUMMARY OF THE INVENTION

One embodiment comprises a container having an interior for holding product therein, comprising an end wall and a peripheral body wall comprising an inner surface and an outer surface. The periphery of the end wall and an end of the body wall rolled together to form a rolled end seam. A one-way seal structure forms a seal between an exterior surface of the rolled end seam and the outer surface of the body wall, and allows gases to escape from the interior of the container to an exterior of the container while inhibiting the entrance of atmospheric air into the interior of the container. In an embodiment, the seal structure allows gases to escape when the pressure of the interior of the container is greater than the pressure on the exterior of the container.

The seal structure may comprise a resilient material, such as an elastomeric material, a plastic, or a rubber. The seal structure may be permanently attached to either the rolled end seam or the outer surface of the body wall of the container. It may be permanently attached to the container using adhesive. In one embodiment, the seal structure is adhered to the rolled end seam. In another embodiment, the seal structure is adhered to the outer surface of the body wall.

The seal structure may deflect from the rolled end seam or from the outer surface of the body wall to allow the gases to escape from the interior of the container. In one embodiment, the seal structure is prevented from adhering to an area along the rolled end seam or the outer surface of the body wall through an applied finish. In one embodiment, the area along the rolled end seam or the outer surface of the body wall is a region that is smaller than the periphery of the rolled end seam. The finish may be a non-adhering food grade lubricant.

In one embodiment, the end portion of the body wall has a section that curves upwardly and a section that curves downwardly forming a hooked shaped portion. Additionally, the periphery of the end wall forms a spiral shaped section, having an upwardly extending wall portion, an upper curved portion, an outer wall that curves downwardly, a lower curved portion, and upwardly extending inner wall. The end portion of the body wall and the periphery of the end wall are rolled together such that the spiral shaped section of the end wall interfaces with the hook shaped portion of the body wall to form the rolled end seam. The rolled end seam is formed with the body wall and the end wall in a slightly spaced relationship for gases to escape from the interior of the container to an exterior of the container therethrough.

In an embodiment, the one-way seal structure forms a seal between the lower curved portion of the spiral shaped section of the end wall and the outer surface of the body wall.

Another embodiment provides a method for forming a container, comprising: providing an end wall; rolling a periphery of the end wall with an upper portion of a peripheral body wall to form a rolled end seam; and after the rolling to form the end seam, providing a one-way seal structure between the rolled end seam and the outer surface of the body wall. The seal structure may comprise a resilient material, and the seal structure may deflect from the rolled end seam or from the outer surface of the body wall to allow the gases to escape from the interior of the container.

The method may further comprise rolling the end wall and body wall such that the end wall and body wall are in a slightly spaced relationship to allow gases to escape from the interior of the container to an exterior of the container. The method may also comprise applying a finish to an area along the rolled end seam or the outer surface of the body wall substrate. The area along which the finish is applied to the substrate is applied to prevent the seal structure from adhering to the area. The method may further comprise applying adhesive to an area along the rolled end seam or the outer surface of the body wall, and permanently attaching the seal structure to the area along the rolled end seam or the outer surface of the body wall of the container. In an embodiment, the area may be a region that is smaller than the periphery of the rolled end seam.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
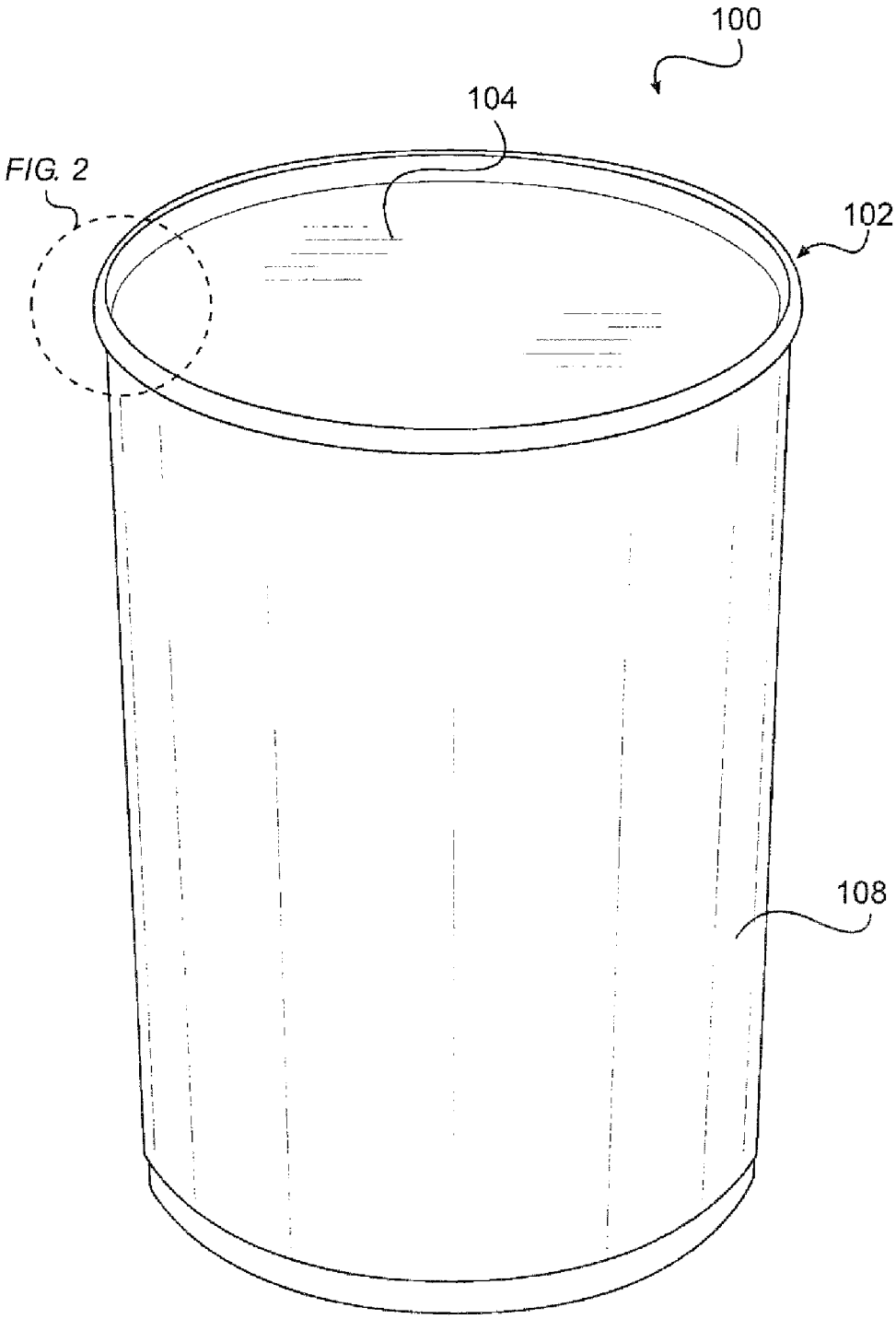
FIG. 1 is a perspective view of a container body in accordance with one embodiment of the present invention.
Figure 2:
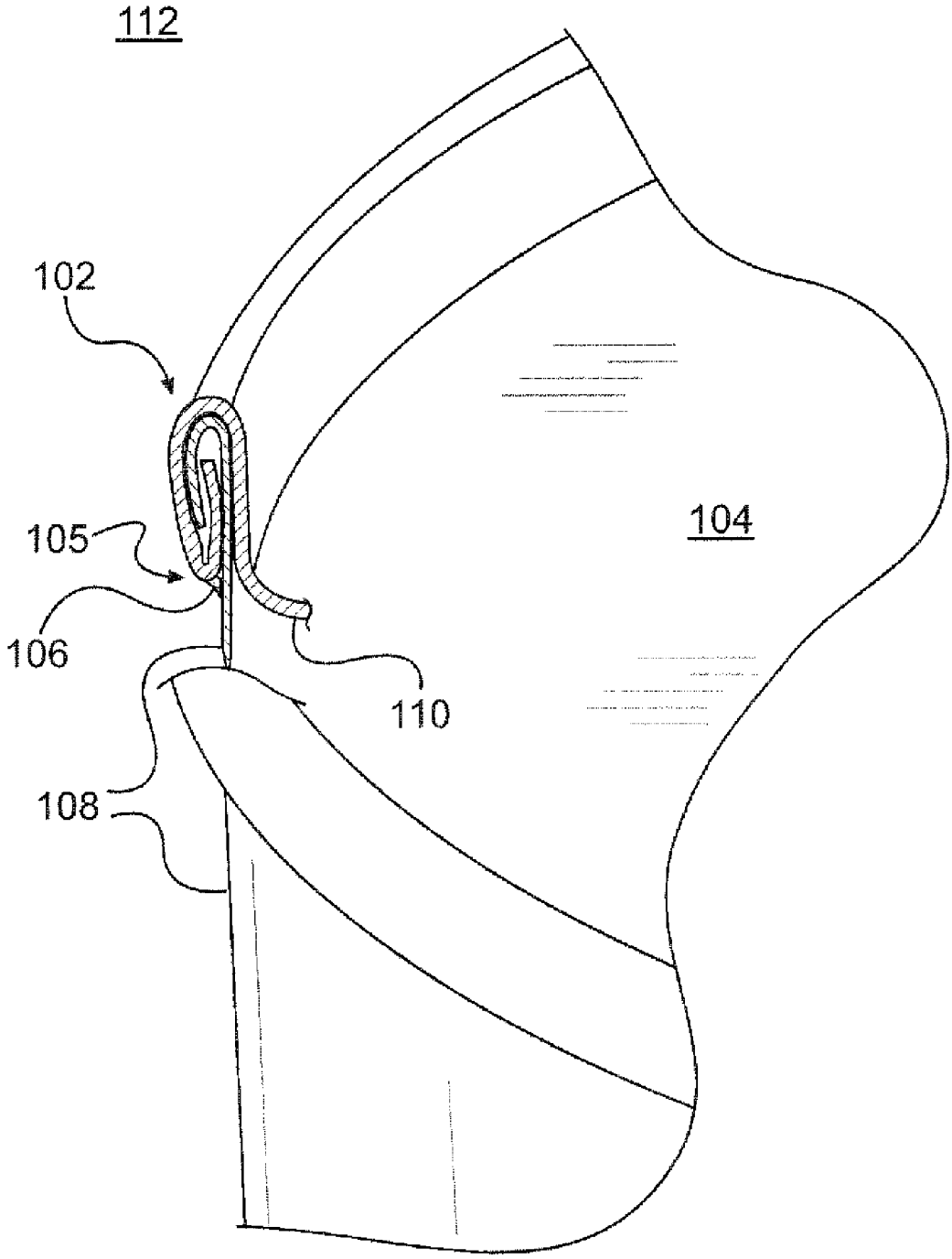
FIG. 2 is a perspective view, partly in section, illustrating the rolled end seam and seal used in the container of FIG. 1.

FIGS. 1 and 2 illustrate a container 100 comprising a circular end wall 104, a peripheral body wall 108, and an annular rolled end seam 102. The periphery of the end wall 104, otherwise known in the art as the seaming panel or seaming wall, and the upper annular end of body wall 108 are rolled together to form a sealed interface between end wall 104 and body wall 108. The formation of a rolled end seam is typically known as double seaming. For example, end wall 104 may be part of a container top, and body wall 108 may be a cylindrical container body. A portion of top wall 104 and portion of body wall 108 are preferably circumferentially rolled together to form the rolled end seam 102 to form a cylindrical container 100 (e.g., a can), further described below.

Figure 3:
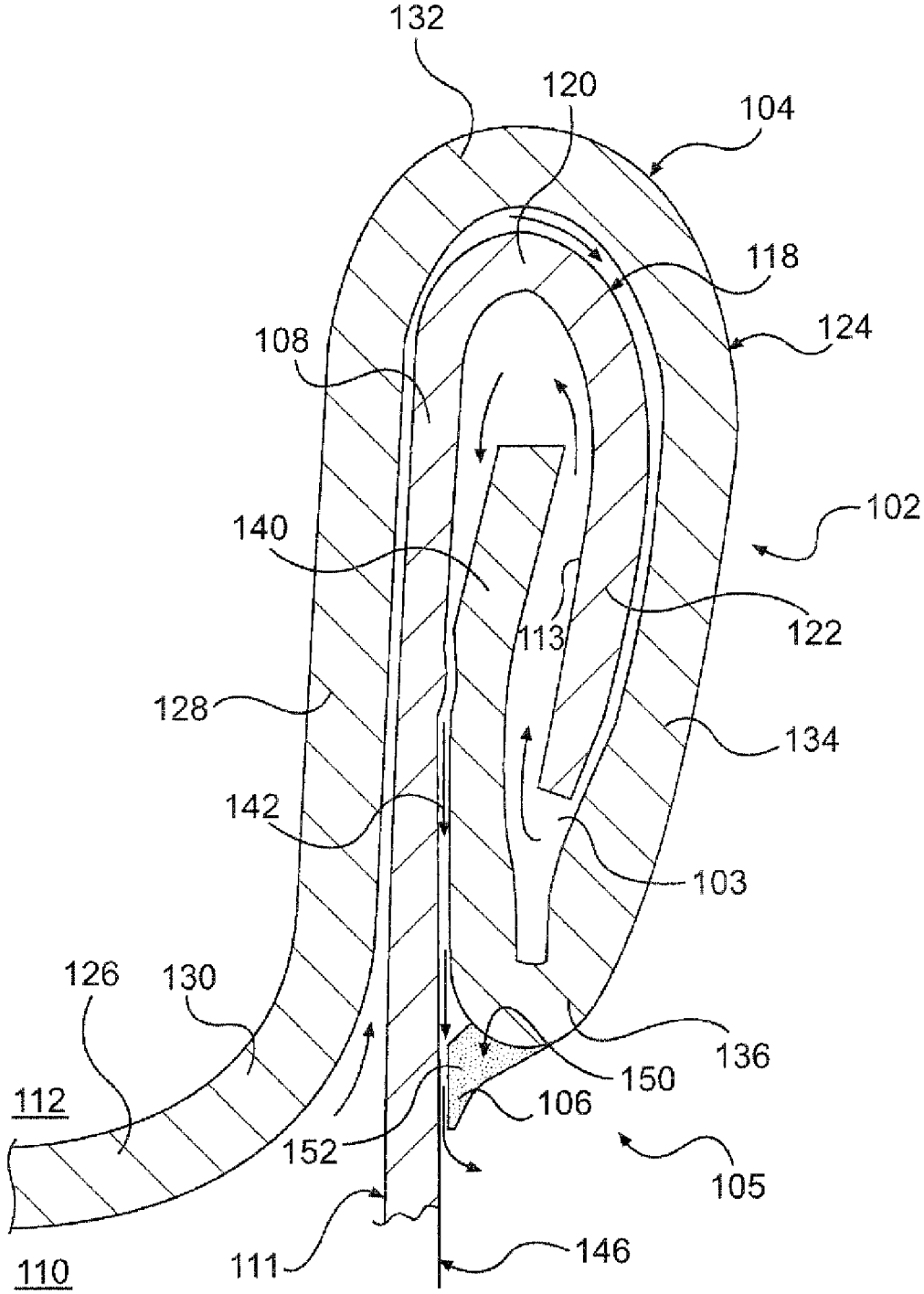
FIG. 3 is a cross sectional view of the container end in accordance with one embodiment, with a seal forming a juncture between a rolled end seam and body wall, with the seal in an open or degassing position.

FIG. 3 illustrates a sectional view of part of the top end of container 100, with rolled end seam 102. The rolled end seam 102 is formed by rolling together the container's top wall 104 and body wall 108. During rolling, channel 103 is created in rolled end seam 102. The channel 103, however, is formed without the addition of a sealant or lining compound. Channel 103, otherwise known as the seam gap, is located between portions of the container top wall 104 and body wall 108. The body wall 108 comprises an inner surface 111 and an outer surface 146 that, when rolled together with end wall 104, defines the channel 103 therebetween (i.e., in the rolled end seam 102). Channel 103 is in communication with interior 110 and exterior 112 of container 100; however, such communication is regulated by the seal structure 106, as discussed below. Exterior 112 is exposed to atmospheric air that may cause degradation of the product in interior 110.

Also shown in FIG. 3 is juncture 105 and seal 106. The top wall 104 and body wall 108 together define the interior 110 of container 100. The rolled end seam 102 is sealed by the seal 106 to prevent atmospheric gases from entering the interior 110 (i.e., through channel 103).

The double seam or rolled end seam 102 is formed partly from an outwardly and downwardly rolled upper portion of the body wall 108, known as the body hook. The end seam 102 is curved or curled to form what appears as an annular upper hook shaped portion 118 of the body wall 108. The body wall 108, towards its upper end thereof, is then rolled outwardly to form a body hook radius or an annular curved upper portion 120, and then downwardly to form a downwardly depending annular leg 122.

The rolled end seam 102 also comprises the top wall 104, or the seaming panel, which is rolled into a configuration that has a generally coiled or spiral shaped cross section 124 that interfaces with the hook shaped portion 118 of the body wall 108, forming an overlap. As shown, top wall 104 is rolled such that it generally forms the exterior of the rolled end seam 102, while the hook shaped portion 118 (i.e., part of the body hook) generally forms the interior.

Assuming main portion 126 of top wall 104 is lying in a horizontal plane, the spiral shaped section 124 has an upwardly extending wall portion 128, known as the chuck wall, that extends generally perpendicularly to the main portion 126. A curved transition region 130 transitions the horizontal main portion 126 into the substantially vertical wall portion 128. The transition region 130 is also defined in the art as the chuck wall radius. The spiral shaped section 124 curves outwardly at upper curved portion 132 and then downwardly along outer wall 134. The spiral shaped section 124 further has a lower curved portion 136, known as pall of an end hook, which curves inwardly back toward an outer surface 146 of can body wall 108, forming the exterior of the rolled end seam 102. The lower curved portion 136 transitions back into an upwardly extending inner wall 140 that extends alongside the outer surface 146 of wall 108 in a slightly spaced relationship therewith, thus forming an end hook. The slightly spaced relationship defines the terminal channel portion 142 of the escape channel or passage 103 for internal gases to exit the interior 110 of the can. The terminal channel portion 142 is defined as being between the outer surface 146 of the body wall 108 and the upwardly extending inner wall 140.

Specifically, gases from interior 110 are released from the container 100 upwardly between the inside of vertical or upwardly extending wall portion 128 (or chuck wall) of the spiral shaped section 124 of the top wall 104 (or seaming panel) and the interior 111 of the body wall 108. The gases continue traveling between the upper curved portion 132 of the seaming panel and the curved upper portion 120 of the body hook, and then travel downwardly between outer wall 134 and downwardly depending leg 122. The gases then travel through the lower curved portion of the end hook and upwardly into hook shaped portion 118 of the body wall 108. The gases continue by traveling upwardly between the upwardly extending inner wall 140 of the end hook and exterior surface 113 of the downwardly depending leg 122 (or body hook) of the body wall 108. The gases then pass the curved upper portion 120 and continue downwardly into terminal channel portion 142. Once the gases travel downwardly through the channel portion 142 between the outer surface 146 of body wall 108 and the upwardly extending wall 140 of the end hook, they may escape through an open end of the seal 106, as will be described.

As can be appreciated from FIG. 3, in one embodiment, seal structure 106 is applied between the lower curved portion 136 of the spiral shaped portion 124 of the top wall 104 (i.e., end hook) and the outer surface 146 of the body wall 108, and extends circumferentially around container 100. In one embodiment, seal 106 has one end 150 thereof securely adhered to curved portion 136 (or end hook), and the opposite end 152 sealingly engaged (contacting) outer surface 146 of body wall 108 when the interior 110 of the container 100 is not above a threshold pressure. Seal 106 is formed of a resilient or flexible material designed to allow for degassing of container 100. As previously noted, some advantages of degassing include helping preserve the products within the package and preventing degradation of the products. When pressure within interior is slightly above or exceeds atmospheric pressure, seal 106 is designed to allow for air, vapors, or pressurizes gases to escape from interior 110 to exterior 112 through channel 103 while inhibiting the entrance of outside or atmospheric air into the interior 110 of container 100 (i.e., and in contact with the contents of a package or container). When interior 110 is at or below atmospheric pressure, the resilient seal is biased against surface 146 to prevent or inhibit atmospheric gases from entering the interior 110 (as described in FIG. 4). Thus, seal 106 acts a one-way seal or one-way valve.

The escape of air or gases from interior 110 of container 100 also assists in vacuum sealing the product(s) in container 100. As noted above, seal 106 comprises a material with a degree of elasticity. Using a material that is elastic or flexible greatly assists in the described degassing process. Examples of such materials may include elastomeric materials, plastics, rubber, or PVC (polyvinyl chloride), but should not be limited to such. As the seal is deflected, gases easily escape from the interior 110 of container 100, as described below.

FIG. 3 shows seal 106 in use and in an open position (i.e., when internal gaseous pressure has flexed the seal 106 to the open position to allow gases to escape from the interior 110). Seal 106 is activated when the pressure of the interior 110 of the container 100 is greater than the pressure on the exterior 112 of the container 100. For example, container 100 may be filled with product(s) and then fully closed (e.g., top and bottom). As the products cool to room temperature, pressure builds within the interior 110 of container 100. The pressurized gases arc designed to open seal 106. The pressurized gases are released through the channel 103 of rolled end seam 102 and through seal 106. Gases that are trapped inside container upon closure are also released. In the preferred embodiment shown in FIG. 3, the end of seal 106 is releasable from the exterior surface of body wall 108.

Figure 4:
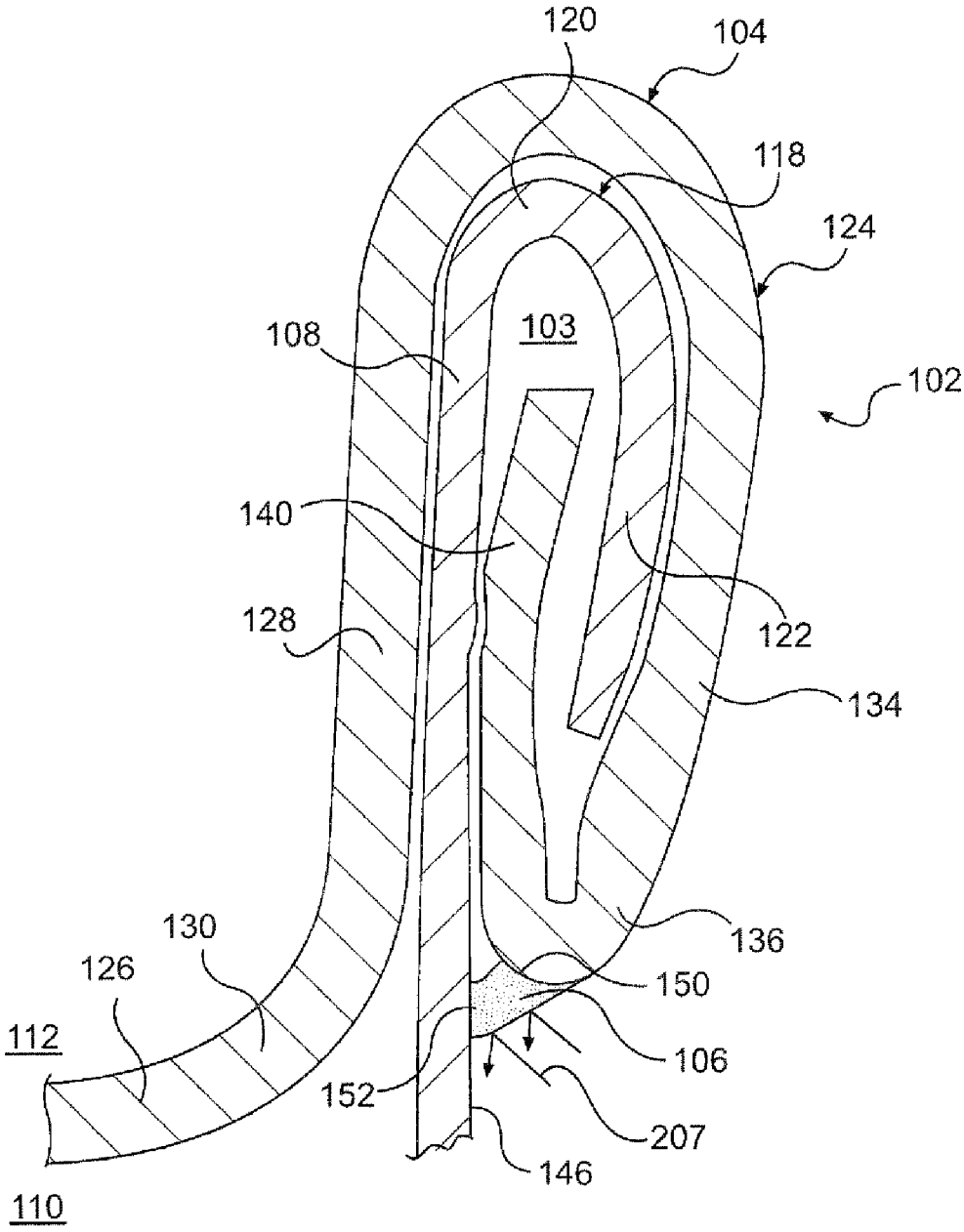
FIG. 4 is a sectional view of the seal of FIG. 3 in a closed or sealed position.

Since seal 106 is a one-way seal, the released gases and atmospheric air are prevented from re-entering the container 100. FIG. 4 shows a sectional view of the container end of FIG. 3 with the seal in a closed position. As noted above, during cooling the pressurized gases cause the opening of seal 106 thus releasing gases from interior 110 to exterior 112 via channel 103. The release of pressurized gases from the hot contents inside 110 the container 100, followed by subsequent cooling of the contents within the container 100, creates a vacuum within container 100. The vacuum causes seal 106 to be pulled and sealed against the outer surface 146 of the exterior wall 108, preventing the entrance of atmospheric air 207 into the channel 103 of rolled seam end 102. Seal 106 thus prevents or substantially inhibits the air 207 from coming into contact with products in interior 110 of the container 100.

Although the seal 106 is described above as being used with a container that is filled and sealed, seal 106 may also be attached to containers that are not immediately filled. For example, seal 106 may be attached to containers that are sold by a supplier to a filling facility. The supplier may sell the container with seal 106 in tact on at least one edge of the container. After filling and sealing at the facility, the pressure in the interior of the container may then be released.

Seal 106 is described as being releasable from the body wall 108 of container 100. Optionally, in another embodiment, the end 152 closest to outer surface 146 of body wall 108 may be permanently attached to the wall outer surface 146 (e.g., by adhesive), and the end 150 of seal 106 closest to the lower curved portion 136 (end hook) of rolled seam 102 is releasably engaged to act as a one-way valve (i.e., sealed or unsealed, depending on pressure within interior 110).

In another embodiment, the seal 106 is permanently attached at both ends 150 and 152 thereof, around the entire circumference of the juncture 105, except for at a specific region (or regions) defined along the periphery of the juncture 105. Just for example, seal 106 may be permanently (e.g., adhesively) attached for 355° at both ends 150, 152 thereof around the periphery of the container, and permanently attached only at end 150 thereof while releasably (flexibly) engaged at the other end 152 thereof for 5°. These portions or degrees of a permanent versus a releasable seal (of 355° vs. 5°) is exemplary only, and can changed based upon the particular application. Alternatively, as another non-limiting example, seal 106 may be permanently attached for 355 degrees at both ends 150, 152 thereof around the periphery of the container, and releasably engaged at the ends 150, 152 for 5 degrees (i.e., such that gas escapes from the 5 degree area at both ends 150 and 152 of seal 106 that are not permanently attached).

To allow for release of pressurized or trapped gases using the above described seal 106, there are several methodologies that may be used for the above mentioned embodiments. It is envisioned that the permanent attachment of the seal 106 to the exterior wall surface 146 or lower curved end 136 be achieved by an adhesive characteristic of the seal material. In one embodiment, lacquers or varnishes such as those that are polyester-, vinyl- or epoxy-based may be applied to an unlacquered container wall to provide a compatible surface for bonding with the seal material. The opposite (i.e., non-permanently engaged surface) may be treated with a film or a finish that prevents permanent adhesion with the seal 106. For example, a non-adhering food grade lubricant may be used on the surface or substrate that sealingly engages with but does not adhere to the seal 106. Examples of non-adhering food grade lubricants may include mineral oil, vegetable oil, or lubricants with a petroleum derivative. The surface finish may be applied to the surface using known applications such as brush, dauber, spray, or dip.

The surface or the substrate, or a film or finish applied to the substrate, may be an area or region along the rolled end seam 102 (e.g., lower curved portion) or the body wall 108 to create a non-adhering surface or region. Specifically, in one embodiment, a substrate, film, or finish may be part of the outer surface 146 of the container body wall 108 such that the seal 106 will not adhere to the wall 108. Another substrate, adhesive, or sealant applied thereto, may be part of the rolled end seam 102 such that seal 106 will adhere and be permanently attached at its end 150.

In another embodiment, the outer surface 146 (or portions thereof of body wall 108 may comprise an adhesive or sealant that will adhere to seal 106 for permanent attachment of such, while the lower curved portion 136 (or portions thereof) of rolled end seam 102 will comprise a substrate or applied finish that will not allow seal 106 to adhere.

In another embodiment, both the outer surface 146 of body wall 108 and the rolled end seam 102 comprise a substrate or an applied finish in a region that will allow for seal 106 to deflect (i.e., ends 150 and 152 are permanently attached at both ends around the entire circumference of the juncture 105, except for at a specific region (or regions)). Somewhere along the periphery of container 100 a substrate or a finish applied thereto is provided in an area or region that will not allow seal 106 to adhere. For example, this region may be only a partially defined area (e.g., 5 degrees) along the periphery (e.g., 360 degrees) of the outer surface 146 of the body wall 108 or the lower curved portion 136 of the rolled end seam 102. This defined region (e.g., 5 degrees) may also be on both the body wall and the rolled end seam (i.e., such that gas escapes from the 5 degree area at both ends 150 and 152 of seal 106 that are prevented from adhering due to the substrate or finish applied to the area(s) of the substrate).

The region to which the adhesive or finish is applied may be a single region or multiple regions along the periphery of the container. For example, the adhesive or finish may be applied around the entire periphery of the container 100 except for a defined region of 5 degrees. Also, the adhesive or finish may be applied in an alternating configuration, such as every 10 degrees around the periphery of the rolled end seam or body wall, such that the seal 106 is releasably attached at multiple areas along the periphery of the juncture 105 formed from the rolled end seam 102 and body wall 108.

Although the above embodiments are described with respect to the seal being attached to the top the container, the seal may also be applied to the bottom of the container. Also contemplated by the invention is the use of two seals, one at either end of the container 100, for releasing gases from the container interior. For example, container 100 may have at least a portion of the bottom wall (not shown) and opposite end of body wall 108 rolled together to form a bottom rolled end seam (not shown). The seal at the bottom of the container may be identical to any one of the embodiments discussed above with respect to the top seal.

The above mentioned description of the seal on the container is not mean to limit the size, shape, configuration, or additional features of the container or product of the subject invention. Further, it is not meant to limit the type or number of seal(s) used or the size, shape, or material used for the seal(s). Moreover, the seals may be attached to different kinds of packaging such as cans, bags, gusseted packages, etc. and to containers formed from a variety of materials such as metals, plastics, papers, foils, etc.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A container having an interior for holding product therein, comprising:

an end wall;

a peripheral body wall comprising an inner surface and an outer surface;

a periphery of the end wall and an end of the body wall rolled together to form a rolled end seam;

a one-way seal structure forming a seal between an exterior surface of the rolled end seam and the outer surface of the body wall; and wherein the one-way seal structure allows gases to escape from the interior of the container to an exterior of the container while inhibiting the entrance of atmospheric air into the interior of the container.

2. A container as per claim 1, wherein the seal structure comprises a resilient material.

3. A container as per claim 1, wherein the seal structure is permanently attached to either the rolled end seam or the outer surface of the body wall of the container.

4. A container as per claim 1, wherein the seal structure is attached to the container using adhesive.

5. A container as per claim 1, wherein the seal structure deflects from the rolled end seam or from the outer surface of the body wall to allow the gases to escape from the interior of the container.

6. A container as per claim 4, wherein the seal structure is adhered to the rolled end seam.

7. A container as per claim 4, wherein the seal structure is adhered to the outer surface of the body wall.

8. A container as per claim 5, wherein the seal structure is prevented from adhering to an area along the rolled end seam or the outer surface of the body wall through the use of a finish applied to the area along the rolled end seam or the body wall.

9. A container as per claim 8, wherein the finish is a non-adhering food grade lubricant.

10. A container as per claim 8, wherein the area along the rolled end seam or the outer surface of the body wall is a region that is smaller than the periphery of the rolled end seam.

11. A container as per claim 2, wherein the material may be an elastomeric material, a plastic, or a rubber.

12. A container as per claim 1, wherein the seal structure allows gases to escape when the pressure of the interior of the container is greater than the pressure on the exterior of the container.

13. A container as per claim 1, further comprising:

the end portion of the body wall having a section that curves upwardly and a section that curves downwardly forming a hooked shaped portion;

the periphery of the end wall forming a spiral shaped section, the spiral shaped section having an upwardly extending wall portion, an upper curved portion, an outer wall that curves downwardly, a lower curved portion, and upwardly extending inner wall;

the end portion of the body wall and the periphery of the end wall being rolled together such that the spiral shaped section of the end wall interfaces with the hook shaped portion of the body wall to form the rolled end seam; and wherein the rolled end seam is formed with the body wall and the end wall in a slightly spaced relationship for gases to escape from the interior of the container to an exterior of the container therethrough.

14. A container as per claim 13, wherein the one-way seal structure forms a seal between the lower curved portion of the spiral shaped section of the end wall and the outer surface of the body wall.

* * * * *